US005402643A

United States Patent [19]

Buchanan et al.

[11] Patent Number: 5,402,643

[45] Date of Patent: Apr. 4, 1995

[54] FLEXIBLE OIL DRAIN TUBE FOR TURBOCHARGER

[75] Inventors: Jerry C. Buchanan; Donna M. Virnig, both of Columbus, Ind.

[73] Assignee: Cummins Engine Company, Inc., Columbus, Ind.

[21] Appl. No.: 165,443

[22] Filed: Dec. 10, 1993

[51] Int. Cl.[6] ..... F02B 33/44

[52] U.S. Cl. ..... 60/605.3; 285/31; 285/175; 285/345; 285/351; 285/368

[58] Field of Search ..... 285/175, 19, 345, 20, 285/368, 31, 32, 189, 351; 60/605.3, 605.1

[56] References Cited

U.S. PATENT DOCUMENTS

| | | | |
|---|---|---|---|
| 2,490,687 | 12/1949 | Guarnaschelli | 285/175 |
| 3,001,804 | 9/1961 | Tomlinson et al. . | |
| 3,584,902 | 6/1971 | Vyse . | |
| 4,028,888 | 6/1977 | Pilarczyk | 285/32 X |
| 4,066,281 | 1/1978 | DeBonis | 285/31 |
| 4,082,318 | 4/1978 | Mueller | 285/19 |
| 4,129,503 | 12/1978 | Joseph | 285/189 X |
| 4,559,782 | 12/1985 | Ritchey et al. | 60/605.3 |
| 4,707,000 | 11/1987 | Torgardh . | |
| 4,844,512 | 7/1989 | Gahwiler . | |
| 4,850,622 | 7/1989 | Suzuki . | |
| 4,874,190 | 10/1989 | Reynolds | 285/189 X |
| 5,094,494 | 3/1992 | McConnell | 285/351 X |
| 5,104,157 | 4/1992 | Bahner . | |

FOREIGN PATENT DOCUMENTS

| | | | |
|---|---|---|---|
| 1155238 | 4/1958 | France | 285/31 |
| WO83/02815 | 8/1983 | WIPO . | |

*Primary Examiner*—Dave W. Arola
*Attorney, Agent, or Firm*—James M. Durlacher

[57] ABSTRACT

An oil drain tube disposed and connected between a turbocharger and an engine block for providing a fluid communication conduit includes a hollow tubular member having a first insertion end which is receivable within an engine block bore, and a second opposite mounting end having a flange for attaching the oil drain tube to the turbocharger. The insertion end of the oil drain tube having a sealing portion which includes two annular grooves with O-rings circumferentially mounted therein, and a stop portion defined by an annular protuberance formed adjacent to the annular grooves of the tubular member. A leak proof connection is provided at the engine block. The protuberance formed on the drain tube abuts the engine block when the drain tube is connected thereto and limits the axial insertion of the drain tube into the bore. The mounting end of the drain tube is spaced axially apart from the insertion end of the drain tube by a flexible tubular portion which enables a service technician to bend the tube as required during installation. The flange, having opposing clearance holes formed therein, is captured on the mounting end of the drain tube. A bolt passing through each clearance hole of the flange is engagable with a threaded bore machined in the turbocharger, and draws the flange into contact with the turbocharger thereby creating a leak-proof connection.

19 Claims, 5 Drawing Sheets

FLEXIBLE OIL DRAIN TUBE FOR TURBOCHARGER

BACKGROUND OF THE INVENTION

The present invention relates in general to the design and construction of tubing assemblies which are used in closed fluid systems. More particularly, the present invention relates to turbocharger oil drain tubes having an integral seal at the engine block.

A turbocharged engine requires a steady flow of clean lubricating oil from the engine to the bearings of the turbocharger. It is just as important to return the lubricating oil from the turbocharger to the engine crankcase to insure that a sufficient supply of oil is available for circulation throughout the engine and turbocharger. A turbocharger oil drain tube provides the conduit for returning the lubricating oil to the crankcase.

In the past, designers of turbocharger oil drain tubes have generally used a combination of rigid preformed tubes and flexible hoses to provide a conduit between an engine and a turbocharger. One approach is to provide an oil drain tube which utilizes a first rigid tube and a second rigid tube that are connected by a flexible hose. The engine block has a bore and one end of the first rigid tube is press fit therein, and one end of the second rigid tube is attached to the turbocharger by a clamp. The two rigid tubes are connected in fluid communication by a flexible hose which utilizes hose clamps to compress the inner surface of the hose against the outer surface of the rigid tube, thereby creating a fluid-tight conduit. A second approach is to provide an oil drain tube which utilizes a single preformed rigid tube connected between the engine and the turbocharger by a pair of short flexible hoses, one each at opposite ends of the rigid tube. The flexible hoses connect the rigid tube to mounting flanges on the engine and turbocharger. Hose clamps compress the inner surface of each short flexible hose against the outer surface of the rigid tube and the associated mounting flanges of the engine and turbocharger, thereby creating a fluid-tight seal.

These two approaches of providing a turbocharger oil drain tube which utilize the combination of rigid tubes and flexible hoses have several common limitations. The first limitation is that oil leakage is inherent at the flexible hose connections. The oil leakage is generally attributed to a combination of assembly misalignment, surface imperfections in the adjoining pieces, and a hostile operating environment which physically degrades the hose. A second limitation is the increased cost of installing an oil drain tube that is comprised of a combination of rigid tubes and flexible hoses. A service technician's time to install an oil drain tube is greatly increased by having to align and interconnect the rigid tubes and flexible hoses. Associated concerns in the design of fluid conduits relate to the specific point to point mounting or connection of the conduit.

There are a variety of fluid-tight couplings and flange devices which have been conceived of over the years. The following listing of references is believed to be representative of such earlier designs:

| PATENT No. | PATENTEE | ISSUE DATE |
|---|---|---|
| 3,001,804 | Tomlinson et al. | Sept. 26, 1961 |
| 3,584,902 | Vyse, | June 15, 1971 |

-continued

| PATENT No. | PATENTEE | ISSUE DATE |
|---|---|---|
| 4,707,000 | Torgardh, | Nov. 17, 1987 |
| 4,844,512 | Gahwiler, | July 4, 1989 |
| 5,104,157 | Bahner, | April 14, 1992 |
| 4,850,622 | Suzuki, | July 25, 1989 |
| APPLICATION NO. | APPLICANT | PUBLICATION DATE |
| PCT/US82/0156 | DAYCO CORP. | AUGUST 18, 1983 |

Even with a variety of earlier designs, there remains a need for a flexible, unitary turbocharger oil drain tube that is easy to install and which eliminates the oil leakage around the hose connection at the turbocharger and engine block. The present invention satisfies this need in a novel and unobvious way.

SUMMARY OF THE INVENTION

To address the unmet needs of prior oil drain tubes, the present invention contemplates an oil drain tube disposed between a turbocharger and an engine block. The flexible oil drain tube for turbochargers according to one embodiment of the present invention comprises a generally cylindrical, tubular member having a first end and a second opposite end, wherein the first end of the tubular member is receivable within a cylindrical hole defined by the engine outer wall. Sealing means connected to the first end of the tubular member provides a leak-proof seal connection at the engine. The sealing means is circumferentially disposed between the first end of the tubular member and the cylindrical hole which is defined by the engine outerwall. Mounting means connected to the second end of the tubular member removeably mounts the oil drain tube to the turbocharger.

One object of the present invention is to provide an improved oil drain tube for a turbocharger.

Related objects and advantages of the present invention will be apparent from the following description.

DESCRIPTION OF THE PREFERRED EMBODIMENT

Figure 1:
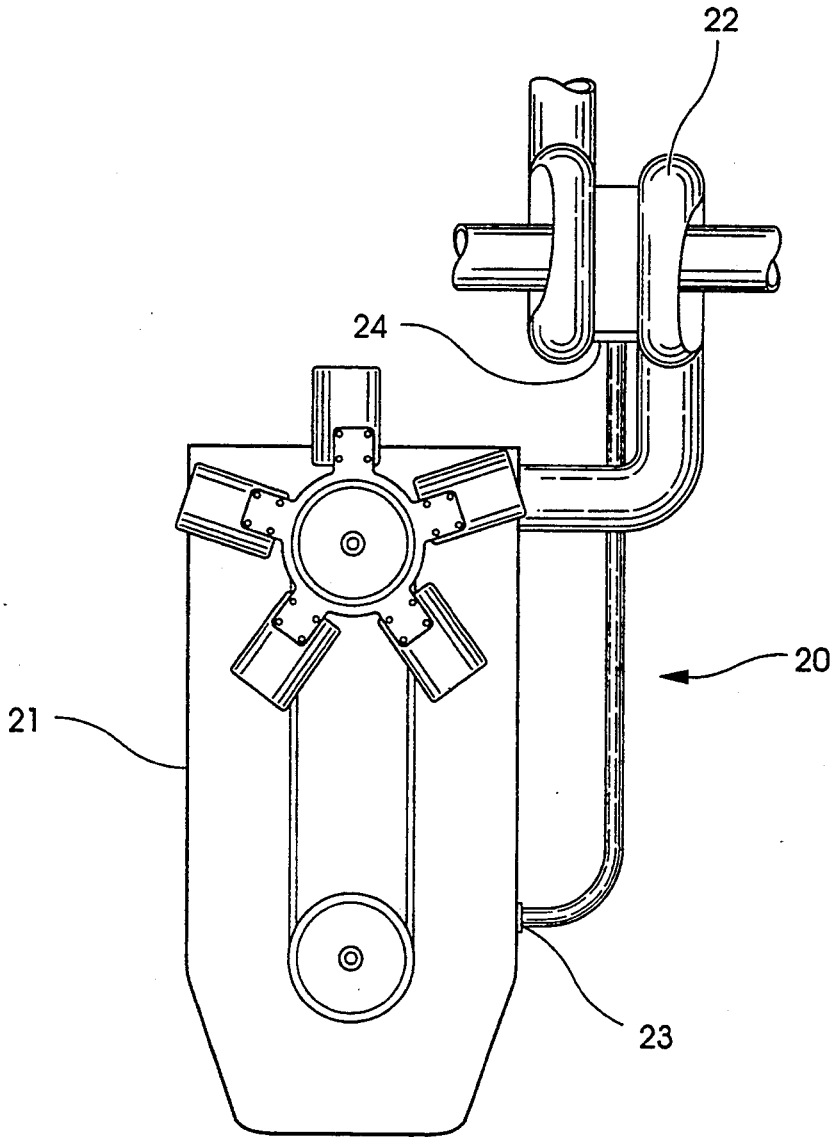
FIG. 1 is a front elevational view of a flexible oil drain tube according to a typical embodiment of the present invention as connected between an engine and a turbocharger.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a flexible oil drain tube 20 which is designed and manufactured in accordance with the present invention. Drain tube 20 is designed to provide a leak free oil return line between the engine block 21 and the turbocharger 22. The drain tube 20 has a first end 23 that is inserted into the engine block 21, and a second end 24 that is bolted to the base of the turbocharger 22.

Figure 2:
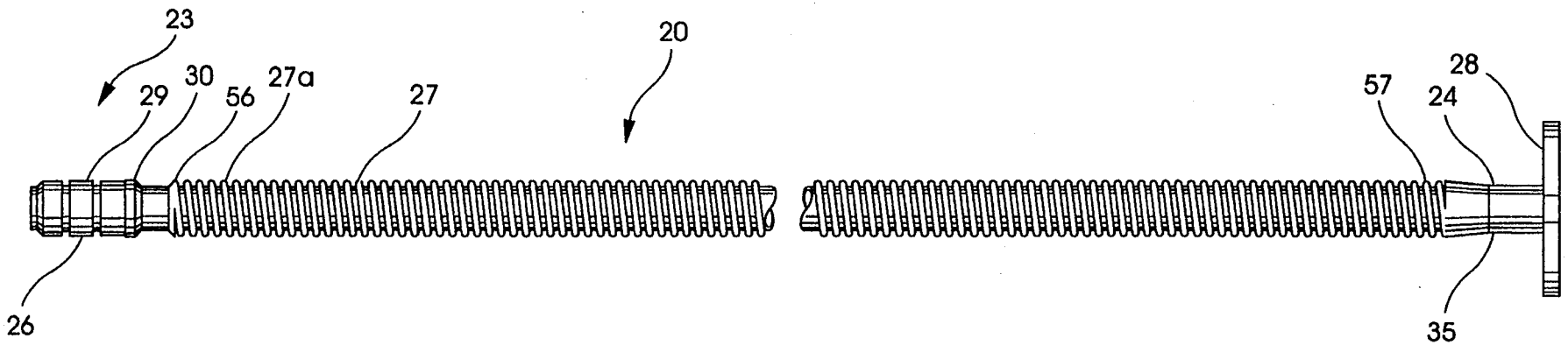
FIG. 2 is a side elevational view of the FIG. 1 flexible oil drain tube.

Drain tube 20, as shown in FIG. 2, is an assembly of two captured components that can be viewed or thought of as having three portions. The three portions include a first end insertion portion 26, a hollow generally cylindrical tubular body member 27, and the second opposite end 24 which includes a mounting flange 28. The mounting flange 28 being captured or formed integral to the drain tube 20. In the preferred embodiment the tubular body member 27 is formed from a single stainless steel cylindrical tube having a wall thickness of 0.012 inches (0.3 millimeters). A suitable material for the mounting flange 28 is sintered powdered metal.

Figure 3:
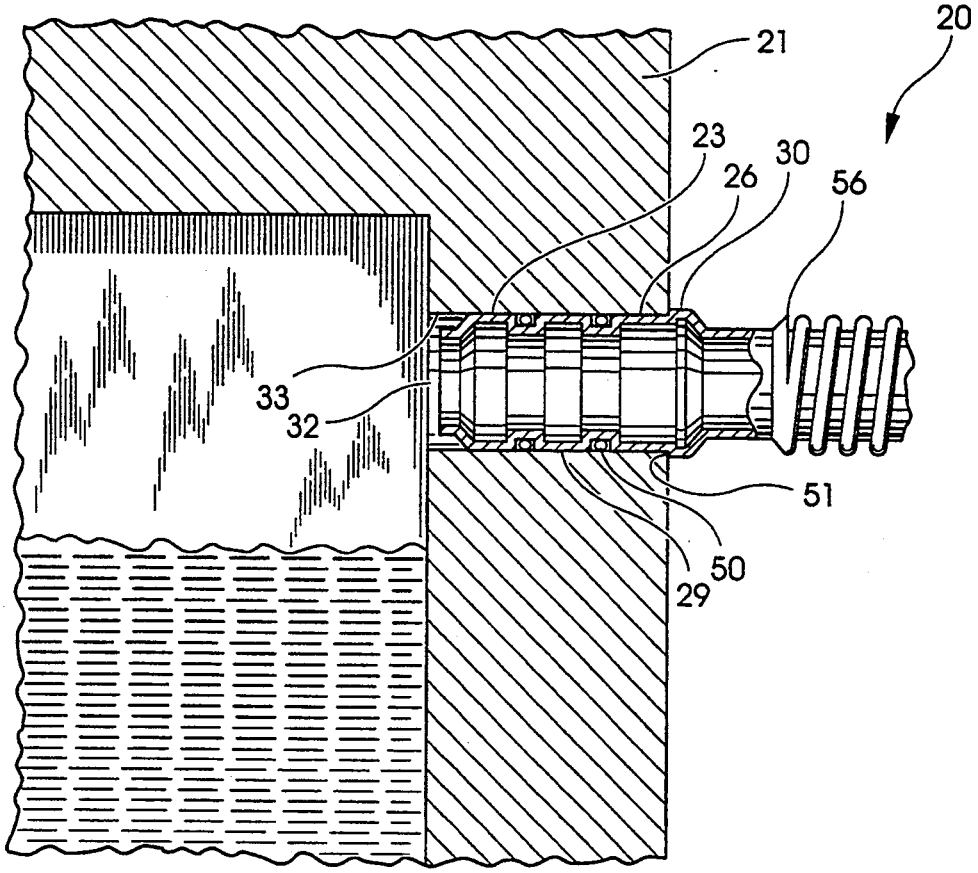
FIG. 3 is a partial side elevational view of one end of the FIG. 2 flexible oil drain tube in full section as connected to an engine block.

With reference to FIGS. 2 and 3, the insertion end 26 includes a sealing portion 29, and a stop portion 30. The insertion end 26 of the drain tube 20 is inserted into an oil drain hole 32 defined in the engine block 21. The insertion end 26 is designed to cooperate with a cylindrical wall surface 33 of the oil drain hole 32 to provide a leak free seal at the engine block 21. These aspects will be described in greater detail hereinafter.

Figure 4:
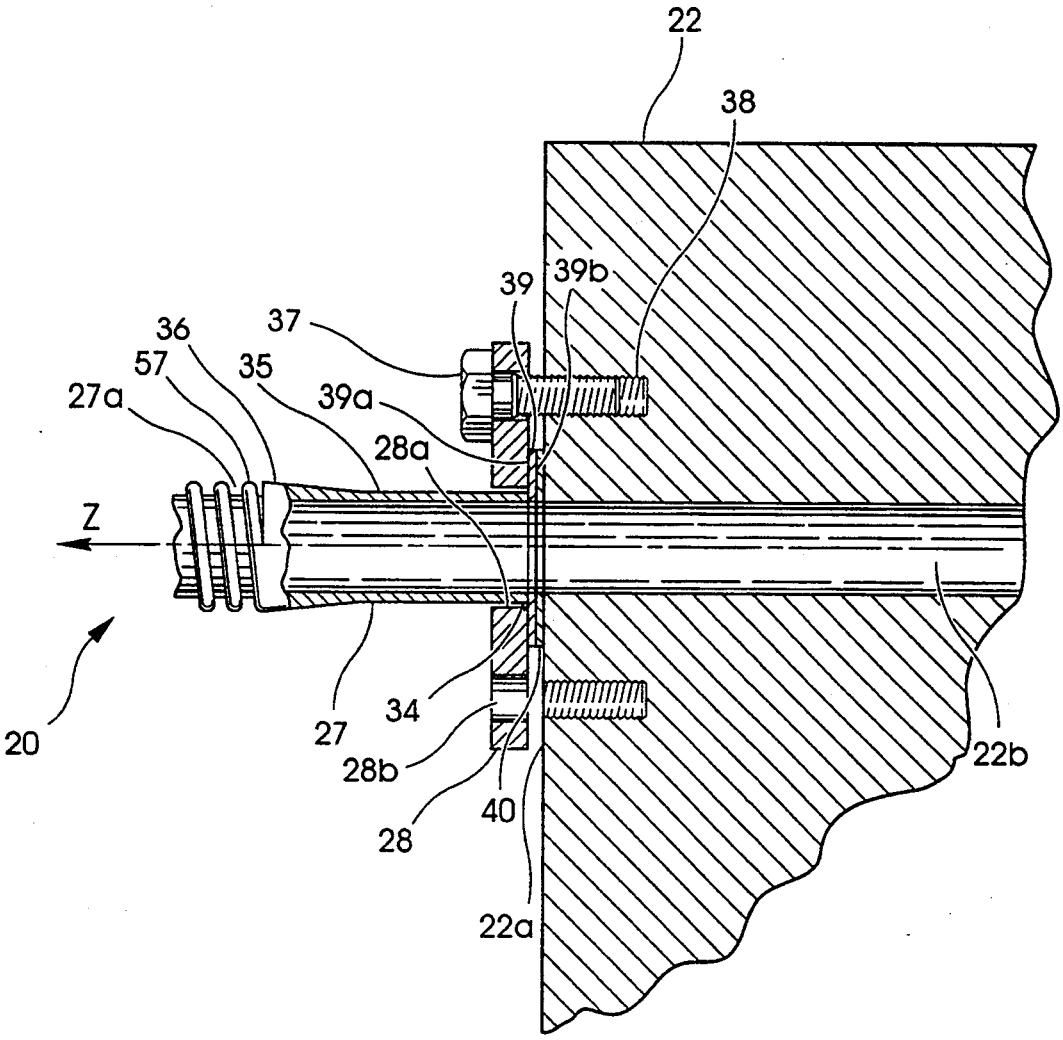
FIG. 4 is a partial side elevational view of another end of the FIG. 2 flexible oil drain tube in full section as connected to a turbocharger.

Referring to FIG. 4, a mounting flange 28 in the preferred embodiment, is formed of sintered powdered metal. The mounting flange 28 has a substantially centrally located hole 28*a* formed therethrough. The diameter of the hole 28*a* is larger than the first outside diameter surface 34 of the flange sliding portion 35 formed in the tubular body member 27. FIG. 4 is a full-section view that is divided by centerline Z.

The flange sliding portion 35 formed in tubular body member 27 of the oil drain tube assembly 20 allows the flange 28 to be moved axially along a portion of the tubular body member 27 by a service technician. The relative size of the first outside diameter surface 34 of the tubular sliding portion 35 of tubular body member 27 is such that the hole 28*a* has a slight clearance therebetween. Further, the flange sliding portion 35 has an increased second outside diameter 36 formed adjacent to a flexible portion 27*a* of tubular member 27. This increased second outside diameter surface 36 limits the axial movement of the flange 28 along the flange sliding portion 35 such that flange 28 is prevented from contacting the flexible portion 27*a* of the tubular body member 27. Limitation of the axial movement of flange 28 along the tubular body member insures that flange 28 will be disposed in close proximity to the turbocharger 22 during the installation of the drain tube assembly 20, thereby simplifying the service technician's job of installing the oil drain tube 20.

The flange 28 has two oppositely positioned clearance holes 28*b* formed therein. The two holes 28*b* are aligned with two corresponding internally threaded bores 38 that are formed into a mounting surface on turbocharger 22. Threaded bores 38 are formed into the turbocharger 22 by drilling and tapping, or alternatively by the use of a threaded insert. A bolt 37 (only one being illustrated) passes through each of the clearance holes 28*b* formed in the flange 28 and engages a corresponding one of the two threaded bores 38. Tightening of the bolts 37 (typically by a service technician) results in the second end 24 of the drain tube 20 being drawn into contact with the turbocharger assembly 22.

In the preferred embodiment the second end 24 of the drain tube 20 has an annular radial flange 39 formed therefrom. The annular radial flange 39 is formed perpendicular to the centerline Z, shown in FIG. 4, of the drain tube 20. The outside diameter of the radial flange 39 is substantially larger than the diameter of hole 28*a* formed in mounting flange 28. The service technician's torquing of bolts 37, draws the mounting flange 28 tightly against an outer surface 39*a* of annular flange 39, which results in an inner surface 39*b* of annular flange 39 engaging a mounting surface 22*a* of the turbocharger assembly 22, thereby providing a tight fluid seal. An annular sealing gasket 40 disposed around turbocharger drain hole 22*b* and between the inner surface 39*b* of annular flange 39 and the outer mounting surface 22*a* of the turbocharger 22 is used in order to improve the seal therebetween and make it fluid-tight.

Figure 5:
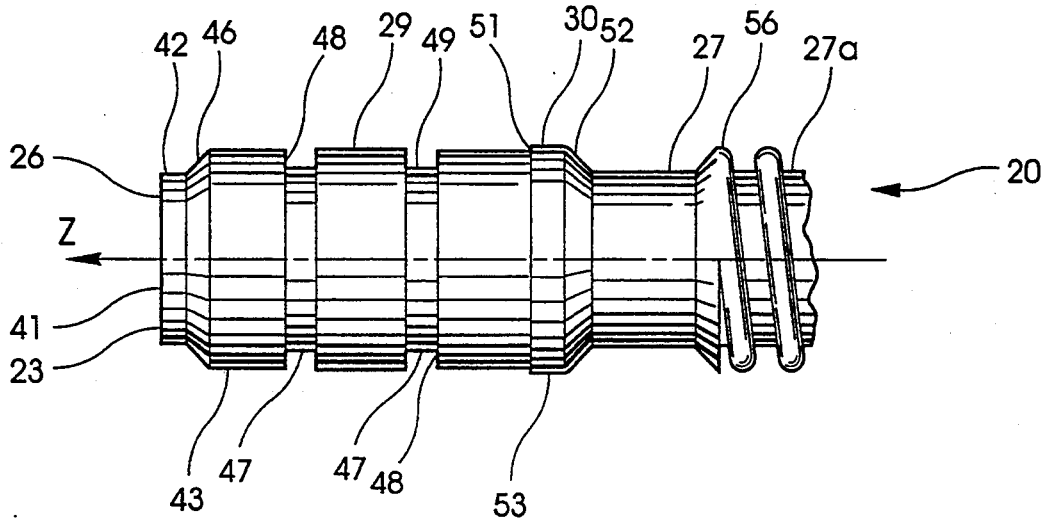
FIG. 5 is a partial, enlarged, side elevational view of one end of the FIG. 2 flexible oil drain tube.

In FIG. 5, there is illustrated with enlarged detail the insertion end 26 of the tubular body member 27 which is defined at the distal end 41 thereof, by a short first tubular section 42 having an outside diameter surface substantially smaller than the outside diameter surface of a second tubular portion 43. The reduced outside diameter surface of the short first tubular section 42 facilitates the insertion of the first end 23 of the drain tube 20 into the oil drain hole 32 which is defined in the engine block 21.

A sloping annular surface 46 formed in tubular body member 27 is disposed adjacent the short first tubular section 42. The annular surface 46 increases in diameter until reaching its maximum diameter which corresponds to the outside diameter of the second tubular portion 43 formed on tubular body member 27. The sealing portion 29 of drain tube 20 is bounded and defined by two annular grooves 47 that are formed in the second tubular portion 43 of tubular body member 27. In the preferred embodiment the annular grooves are formed by rolling the second tubular portion 43 of tubular body member 27, thereby displacing a predetermined amount of material from which the tube is formed. Alternatively, the two annular grooves 47 can be formed in the second tubular section 43 by any other suitable manner.

The two annular grooves 47 formed in the second tubular section 43 have a rectangular cross-sectional area defined by parallel sidewalls 48. The parallel sidewalls 48 of annular grooves 47 are formed in tubular member 27 substantially perpendicular to the centerline Z, shown in FIG. 5, of drain tube 20. The base wall 49 of each annular groove 47 is formed parallel to the centerline Z of the drain tube 20 and connects between the parallel sidewalls 48 that define the annular grooves 47 in the tubular body member 27.

An O-ring flexible seal 50, illustrated in FIG. 3, is positioned circumferentially into each annular groove 47 defined in the tubular body member 27. Each flexible O-ring seal is produced from a natural or synthetic elastomeric compound. The preferred embodiment utilizes two O-rings 50 positioned in the annular grooves 47 defined in the sealing portion 29 of drain tube 20. In FIG. 3, there is illustrated a cross-sectional view of sealing portion 29 of the drain tube 20 with the O-rings positioned circumferentially into each annular groove 47. When the first end 23 of the drain tube assembly 20 is inserted within the oil drain hole 32 of the engine block 21, an outer annular surface defined by the O-rings 50 is held in circumferential contact with the cylindrical wall surface 33 of the oil drain hole 32. The cylindrical wall surface 33 imparts a radial force on the O-rings 50. The force causes the O-rings 50 to be compressed slightly, thereby providing an interference fit between the cylindrical wall surface 33 of the oil drain hole 32 and the outer annular surface of O-rings 50 which prevents the leakage of oil from the engine block 21.

The two annular grooves 47 are spaced axially apart on the second tubular portion 43, with one of the annular grooves being formed adjacent to the stop portion 30 of tubular body member 27. Stop portion 30 is defined by a protuberance on the tubular body member 27 that assists the service technician in connecting the drain tube 20 between an engine block 21 and a turbocharger assembly 22. The stop portion 30 facilitates the installation of the drain tube 20 to the engine block by limiting the axial length of the tubular body member 27 that is inserted into the oil drain hole 32. The stop portion 30 is defined on the tubular body member 27, by a section of tubing having an outer diameter surface larger than the oil drain hole diameter surface 32.

In the preferred embodiment the stop 30 comprises an annular protuberance that is defined by a perpendicular annular surface 51 and a sloping annular surface 52. The annular surface 51 is formed in the tubular body member 27 perpendicular to the centerline Z of the drain tube 20. The perpendicular annular surface 51 extends outwardly from the outer surface of tubular body member 27 such that the annular surface 51 has an outside diameter larger than the opening in the engine block 21 defined by oil drain hole 32. The perpendicular annular surface 51 and the sloping annular surface 52 are separated by a cylindrical tubular member 53. The sloping annular surface 52 is inclined at a forty-five degree angle to the centerline Z of the drain tube 20, and its diameter decreases in size from the outside diameter of perpendicular annular surface 51 to the outside surface diameter of the first tubular section 41.

When the oil drain tube 20 is installed between the engine block 21 and the turbocharger assembly 22 , the perpendicular annular surface 51 of stop 30 defined on drain tube 20 abuts the exterior surface of the engine block 21. The exterior surface of engine block 21 that the stop 30 abuts is located circumferentially adjacent to the outer periphery of oil drain hole 32.

The flexible tubular portion 27*a* of tubular body member 27 has a first end 56 formed adjacent to the sloping annular surface 52, and a second end 57 formed adjacent to the flange sliding portion 35. In the preferred embodiment, the flexible tubular portion 27*a* is produced by rolling the tubular body member 27 to displace a predetermined amount of material to create alternating ridges and grooves on the tubular body member 27 between a first end 56 and a second end 57. The alternating ridges and grooves define a corrugated section of tubing that has a substantial degree of flexibility. The corrugations allow the flexible portion 27*a* of the tubular body member 27 to be readily formed by the service technician during installation of the oil drain tube 20. The ease of bending the oil drain tube 20 facilitates the installation of the conduit between the engine block 21 and the turbocharger 22.

Figure 6:
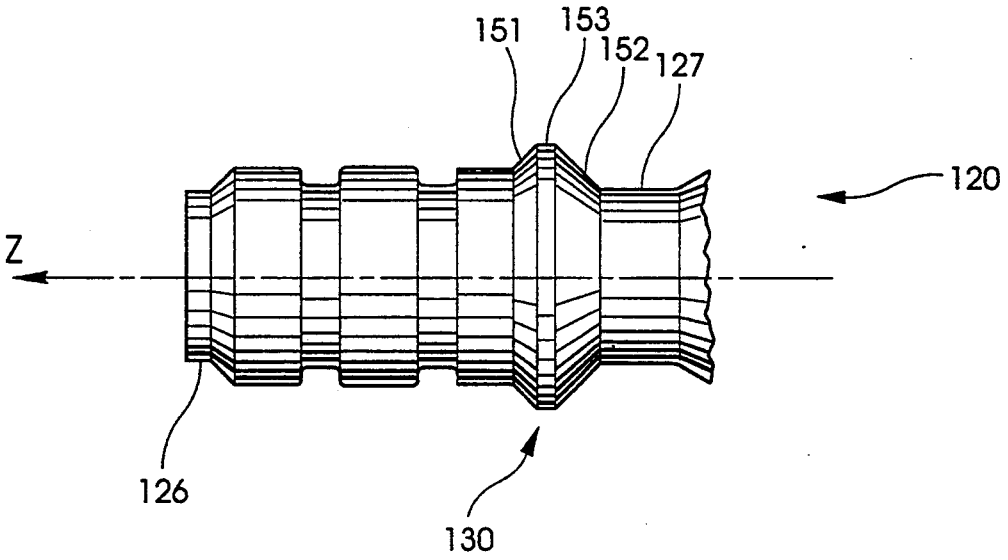
FIG. 6 is a partial, enlarged, side elevational view of one alternative feature for the FIG. 2 oil drain tube.

As one alternative of the present invention, as illustrated in FIG. 6, the insertion stop (item 30 in FIG. 2, now item 130) is defined by two sloping and converging annular surfaces 151 and 152. The general construction and function of the corresponding drain tube 120 is virtually the same as drain tube 20 in all other aspects. The two sloping annular surfaces 151 and 152 converge to form an annular ridge 153 that protrudes from the tubular member 127 and represents the greatest outside diameter. The sloping annular surface 151 abuts up against the engine block when the insertion end 126 of drain tube 120 is inserted in the oil drain hole. The sloping annular surface 151 increases in diameter to a maximum size corresponding to the outside diameter of ridge 153. Sloping annular surface 152 is inclined at a 45 degree angle to the centerline Z, and its diameter decreases until reaching the nominal diameter of tubular body member 127.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A conduit for connecting a first member and a second member in fluid communication that is separate and apart from a structure supporting the members, said conduit comprises:

a generally tubular member having a first insertion end and an oppositely disposed second mounting end, wherein the insertion end of said tubular member is receivable within a generally cylindrical bore defined in said first member;

said tubular member being substantially flexible and shapeable for routing between the first member and the second member;

sealing means assembled to the insertion end of said tubular member for providing a leak-proof connection between said first member and said conduit, said sealing means being disposed within said cylindrical bore in circumferential contact with a wall surface defined by said cylindrical bore; and mounting means connected to the mounting end of said tubular member for attaching said conduit to said second member with a leak-proof connection.

2. The conduit of claim 1 which further includes a stop portion having an outwardly protruding shoulder that abuts said first member for limiting the axial length of the conduit inserted into said cylindrical bore, and wherein said insertion end defining a section for facilitating the penetration of said insertion end into said cylindrical bore.

3. The conduit of claim 2, wherein said mounting means includes:

a flange being concentrically slidably molted to the second end of said tubular member, said flange having two clearance holes defined therein; and a pair of threaded bolts, one each passing through each clearance hole, each bolt being received by mating threads in said second member.

4. The conduit of claim 3, wherein said mounting end of said tubular member having an annular ring formed thereon, and wherein said annular ring being disposed adjacent said second member for providing a tight fluid seal.

5. The conduit of claim 4, wherein the second end of said tubular member having a sliding portion for said flange too slide axially thereon, and wherein said sliding portion limits the axial member of said flange for locating said flange proximate said second member.

6. The conduit of claim 5, wherein said sealing means includes:

two annular grooves defined in said tubular member, said annular grooves being spaced axially apart; and an O-ring mounted within each annular groove.

7. The conduit of claim 1 wherein said first member is an engine block, and said second member is a turbocharger.

8. The conduit of claim 1, wherein said mounting means includes:

a flange slidably received on the second end of said tubular member, said flange having a substantially central aperture therethrough, and wherein said aperture defines a surface having a diameter larger than said tubular member.

9. The conduit of claim 1, wherein said sealing means includes:

two annular grooves defined in said tubular member, said annular grooves being spaced axially apart; and an O-ring mounted within each annular groove.

10. An oil drain tube disposed between and connected at a first end to a turbocharger and at a second opposite end to an engine block having an oil drain hole, said oil drain tube comprising:

a generally tubular member having a first insertion end and an oppositely disposed second mounting end, wherein the insertion end of said tubular member is receivable within said oil drain hole of said engine block;

said tubular member being substantially flexible and shapeable for routing between the turbocharger and the engine block;

at least one annular gasket assembled to the insertion end of said tubular member for providing a leak-proof connection between said engine block and said drain tube, said gasket circumferentially contacting a cylindrical wall surface defined by said oil drain hole; and an attachment flange means moveably connected to the mounting end of said tubular member for attaching said drain tube to said turbocharger with a leak-proof connection.

11. The oil drain tube of claim 10 which further includes a stop member having an outwardly protruding shoulder that abuts said engine block for limiting the axial distance said conduit is insertable into said oil drain hole, and wherein said insertion end having a portion for facilitating the introduction of said insertion end into said oil drain hole.

12. The oil drain tube of claim 11, wherein said attachment flange means is connected to the second end of said tubular member, said flange means having two clearance holes defined therein; and a pair of threaded bolts, one each passing through each clearance hole, each bolt being received by mating threads in said turbocharger.

13. The oil drain tube of claim 12 wherein said second end of said tubular member having an annular ring formed thereon, and wherein said annular ring being disposed adjacent said turbocharger for providing a tight fluid seal.

14. The oil drain tube of claim 13 which further includes a gasket positioned between said annular ring and said turbocharger.

15. The oil drain tube of claim 13, wherein the second end of said tubular member having a sliding portion for said flange means to slide axially thereon, and wherein said sliding portion limiting the axial movement of said flange means for positioning said flange means proximate the turbocharger.

16. The oil drain tube of claim 15, wherein said insertion end includes:

two annular grooves defined in said tubular member, said annular grooves being spaced axially apart; and a said annular gasket is mounted within each annular groove.

17. The oil drain tube of claim 10, wherein said attachment flange means is connected to the second end of said tubular member, said flange means having two clearance holes defined therein; and a pair of threaded bolts, one each passing through each clearance hole, each bolt being received by mating threads in said turbocharger.

18. The oil drain tube of claim 10, wherein said insertion end includes:

two annular grooves defined in said tubular member, said annular grooves being spaced axially apart; and an annular gasket is mounted within each annular groove.

19. In combination:

an engine block having an oil drain hole defined therein;

a turbocharger; and a connecting conduit comprising:

a generally tubular member having a first insertion end and a second oppositely disposed mounting end, wherein the insertion end is receivable within said drain hole, and said tubular member being substantially flexible between said first end and said second end for routing between the engine block and the turbocharger;

sealing means assembled to the insertion end of said tubular member for providing a leak-proof connection between said engine block and said conduit, said sealing means being circumferentially disposed within said oil drain hole between said tubular member and cylindrical wall surface defined by said oil drain hole;

a stop having an outwardly protruding shoulder that abuts said engine block, said stop not being mechanically affixed to said engine block; and mounting means connected to the mounting end of said tubular member for attaching said conduit to said turbocharger with a leak proof connection.

* * * * *